US012509887B2

(12) United States Patent
Li

(10) Patent No.: US 12,509,887 B2
(45) Date of Patent: Dec. 30, 2025

(54) POINTING TOOL

(71) Applicants: HANGZHOU UNITED TOOLS CO., LTD., Hangzhou (CN); HANGZHOU GREAT STAR INDUSTRIAL CO., LTD., Hangzhou (CN)

(72) Inventor: Jingjian Li, Hangzhou (CN)

(73) Assignees: Hangzhou United Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 391 days.

(21) Appl. No.: 18/157,164

(22) Filed: Jan. 20, 2023

(65) Prior Publication Data

US 2023/0151619 A1 May 18, 2023

Related U.S. Application Data

(63) Continuation-in-part of application No. PCT/CN2020/103290, filed on Jul. 21, 2020.

(51) Int. Cl.
*E04F 21/165* (2006.01)

(52) U.S. Cl.
CPC ..... *E04F 21/1652* (2013.01)

(58) Field of Classification Search
CPC ... A46B 5/0095; A46B 5/0016; B23B 51/101; B25G 3/06

(Continued)

(56) References Cited

U.S. PATENT DOCUMENTS 4,419,029 A * 12/1983 Wenzel ..... F16B 37/16 403/388
5,661,865 A * 9/1997 Humphrey ..... B44D 3/006 401/122

(Continued)

FOREIGN PATENT DOCUMENTS

CN 201818032 U 5/2011
CN 204941735 U 1/2016

(Continued)

OTHER PUBLICATIONS

International Search Report for PCT Application No. PCT/CN2020/103290, mailed Apr. 21, 2021.

(Continued)

*Primary Examiner* — Tom Rodgers
(74) *Attorney, Agent, or Firm* — Andrus Intellectual Property Law, LLP

(57) ABSTRACT

The present invention discloses a pointing tool comprising a working member and a gripping member. The working member is coupled to the gripping member. The working member is adjustable. A surface of the working member is a polygonal prismatic outer surface including a plurality of circular cylindrical surfaces with different radii of curvature. A first connecting member and a second connecting member each extend from one end of the gripping member. The working member includes a first working member and a second working member. The first working member and the second working member are rotatably disposed over the connecting members. A stop mechanism is further included and configured to stop and release the working members. A sealing member is further included and disposed in a terminal portion of the first working member in order to prevent particulate matter from entering the inside of the working member. The present invention has the advantages (Continued)

of a simple structure, convenient adjustability, high operating efficiency and low cost.

18 Claims, 10 Drawing Sheets

(58) Field of Classification Search
USPC ..... 15/105.5; 30/169; 7/168, 167
See application file for complete search history.

(56) References Cited

U.S. PATENT DOCUMENTS

| | | | | |
|---|---|---|---|---|
| 2004/0250364 | A1* | 12/2004 | Kairys | E04F 21/1655 15/105.5 |
| 2006/0150357 | A1 | 7/2006 | Bongiovanni | |
| 2011/0203064 | A1 | 8/2011 | Gringer | |

FOREIGN PATENT DOCUMENTS

| | | | | |
|---|---|---|---|---|
| CN | 206667698 | U | 11/2017 | |
| CN | 206667699 | U | 11/2017 | |
| CN | 208105803 | U | 11/2018 | |
| CN | 208987008 | U | 6/2019 | |
| CN | 209385447 | U | 9/2019 | |
| CN | 209443732 | U | 9/2019 | |
| CN | 110561361 | A | 12/2019 | |
| CN | 210244718 | U | 4/2020 | |
| CN | 212105012 | U | 12/2020 | |
| CN | 212271536 | U | 1/2021 | |
| JP | 2003172022 | A | 6/2003 | |
| WO | WO-2004033820 | A1 * | 4/2004 | E04F 21/1655 |
| WO | 2019016785 | A1 | 1/2019 | |
| WO | 2020095073 | A1 | 5/2020 | |

OTHER PUBLICATIONS

Office Action for Chinese Patent Application No. 202010706954.X, mailed Aug. 22, 2025.

* cited by examiner

POINTING TOOL

RELATED APPLICATION

This application is a continuation-in-part (CIP) application claiming benefit of PCT/CN2020/103290 filed on Jul. 21, 2020, the disclosure of which is incorporated herein in its entirety by reference.

The present invention relates to the field of building construction and, in particular to a pointing tool.

DESCRIPTION OF THE PRIOR ART

In the field of construction, bricklaying is one of the common construction activities. During bricklaying, gaps are left between adjacent bricks. One reason for this is that perfect fitting of bricks is impossible because they could not be perfectly made or because abrasion is inevitable. Another reason is that it is sensible to reserve spaces between bricks in order to accommodate their thermal expansion. Otherwise, bricks may be squeezed by each other at raised temperatures, which may lead to cracking or deformation. Pointing refers to filling of such gaps with a filling material, which may be either directly the cement or binder used to stabilize the bricks, or a filling material specially designed for pointing. Before the filling material becomes dry and invariable in shape, a pointing tool can be used to surface finish the filling material for practical or aesthetic purposes. In addition, pointing may also be applied between the floor and walls for the purposes of waterproofing, aesthetics and gap filling.

Different applications have different pointing requirements. For example, in applications with demanding waterproofing and drainage requirements, cross-sectional "V-shaped" or similar recessed gaps are needed because such "V-shaped" gaps allow not only rapid drainage of water but also denser filling of filling materials, which is favorable for waterproofing performance. In other instances, possibly for aesthetic or other reasons, it is necessary to form gaps of various cross-sectional shapes. Even gaps of the same cross-sectional shape will have different surface shapes due to various sizes. Therefore, working members of pointing tools are required to have various surfaces that can meet different application requirements.

In the prior art, most pointing tools are integral structures having surfaces of fixed shapes, and therefore, can only fill gaps of respective determined cross-sectional shapes. For this reason, a construction worker has to carry a set of pointing tools with her/him in order to be able to fill various gaps. This is costly and introduces inconvenience. Although there are some pointing tools in the prior art having two different surfaces, due to the structurally integral nature, their working members do not allow angular adjustment. As a consequence, the use of the different surfaces may cause inconvenient gripping and inferior construction results.

Therefore, those skilled in the art are directing their effort toward developing a pointing tool, which has a working member with multiple surfaces of different shapes while offering convenient gripping, allows easy surface shape adjustments as required, and can prevent a filling material from entering the inside of the pointing tool.

SUMMARY OF THE INVENTION

In view of the above described shortcomings of the prior art, the problem sought to be solved by the present invention lies in how to provide an adjustable pointing tool including multiple different curved surfaces and capable of presenting the entry of particulate matter.

In order to solve the above problem, the present invention provides a pointing tool comprising a working member and a gripping member, the working member coupled to the gripping member, wherein the working member is configured to be able to rotate to adjust a working surface, the working surface comprising a plurality of curved surfaces.

Additionally, a first connecting part extends from one end of the gripping member, and the working member comprises a first working member. The first working member is rotatably disposed over the first connecting part, and a stop mechanism is further included. The stop mechanism is configured to maintain the first working member at a constant position with respect to the first connecting part.

Additionally, the stop mechanism comprises a polygonal prismatic stop recess provided at an inner surface of the first working member and a polygonal prismatic stop body provided in a terminal portion of the first connecting part. The polygonal prismatic stop body matches the polygonal prismatic stop recess in size and shape. The polygonal prismatic stop recess has degrees of surface curvature matching degrees of curvature of an outer surface of the first working member at corresponding positions. When the first working member is laterally moving over the first connecting part, the polygonal prismatic stop body is able to engage with or leave from the polygonal prismatic stop recess. The polygonal prismatic stop body engages with the polygonal prismatic stop recess to maintain the first working member at a constant position with respect to the first connecting part, and the polygonal prismatic stop body disengages from the polygonal prismatic stop recess to enable the first working member to be rotatable about the first connecting part.

Additionally, the stop mechanism further comprises a locking pin fixedly coupled to the polygonal prismatic stop body. The locking pin is inserted and pulled out to enable the polygonal prismatic stop body to engage with and disengage from the polygonal prismatic stop recess.

Additionally, the stop mechanism further comprises a spring disposed within the first working member. The spring is disposed over the first connecting part together with the polygonal prismatic stop body. One end of the spring is coupled to the terminal portion of the first working member, and another end thereof to a base portion of the first connecting part. The spring is compressed when the polygonal prismatic stop body disengages from the polygonal prismatic stop recess and returns to a rest state in absence of an external force to enable the polygonal prismatic stop body to engage with the polygonal prismatic stop recess.

Additionally, an inner surface of the terminal portion of the first working member is provided with a collar, and one end of the spring is coupled to the collar. The base portion of the first connecting part is provided therein with a trailing cover receptacle, and a trailing cover is snapped into the trailing cover receptacle and thereby fixedly coupled to the first connecting part. The spring is fixedly coupled to the trailing cover at the other end.

Additionally, the polygonal prismatic stop body and the trailing cover are integrally formed over the first connecting part.

Additionally, the outer surface of the first working member is triangular prismatic, or quadrangular prismatic, or pentagonal prismatic, or hexagonal prismatic.

Additionally, a sealing member is further included, which is disposed in the terminal portion of the first working member.

Additionally, the first working member is coupled to the gripping member at a base portion of the first connecting part. Either of the first working member and the gripping member is provided therein with a plurality of elongate stop recesses, and the other of them is provided thereon with elongate stop body matching the elongate stop recesses in size. When the first working member is laterally moving over the first connecting part, the elongate stop body is able to engage with or leave from the elongate stop recesses. The elongate stop body engages with the elongate stop recesses to maintain the first working member at a constant position with respect to the first connecting part, and the elongate stop body disengages from the elongate stop recesses to enable the first working member to be rotatable about the first connecting part.

Additionally, the number of the elongate stop recesses is the same as the number of the elongate stop body.

Additionally, the stop mechanism further comprises a trailing plug provided in a terminal portion of the first connecting part. The trailing plug is configured to limit a lateral position of the first working member and, through altering a lateral position of the trailing plug, control engagement and disengagement of the elongate stop body with and from the elongate stop recesses.

Additionally, the trailing plug comprises an elongate rotary handle configured to be raised over an end face of the first working member and used to change the lateral position of the trailing plug.

Additionally, the trailing plug comprises an elongate groove used to change the lateral position of the trailing plug.

Additionally, the stop mechanism comprises a metal wire, one end of which is coupled to the first connecting part. The first working member is provided in a terminal portion thereof with a stop groove matching the metal wire in size. Engagement of another end of the metal wire with the stop groove results in the first working member being stopped, and disengagement of another end of the metal wire from the stop groove results in adjustability of the first working member.

Additionally, the first connecting part is provided in a surface thereof with metal wire securing holes, and the metal wire is inserted into the metal wire securing holes to be pivotably coupled to the first connecting part.

Additionally, the first connecting part comprises a threaded rod, and the first working member is fixedly coupled to the threaded rod. The threaded rod is rotatably coupled to the gripping member, and a side face of a base portion of the first working member is engaged with a side face of the gripping member. One of the side face of the base portion of the first working member and the side face of the gripping member is provided thereon with raised beads, and the other of them is provided therein with bead receiving pockets. The raised beads and the bead receiving pockets are arranged around the threaded rod. The raised beads are in positional correspondence with the bead receiving pockets. When the first connecting part is being rotated with the threaded rod relative to the gripping member, the raised beads are able to engage with or leave from the bead receiving pockets. The raised beads engage with the bead receiving pockets to maintain the first working member at a constant position with respect to the first connecting part, and the raised beads disengages from the bead receiving pockets to enable the first working member to be rotatable about the first connecting part.

Additionally, a second connecting part extends from an end of the gripping member opposite to the first connecting part, and the working member comprises a second working member disposed over the second connecting part.

Additionally, the first working member differs from the second working member in outer surface shape and size, and the first connecting part has the same structure as that of the second connecting part.

Additionally, the outer surface of the first working member is triangular prismatic, or quadrangular prismatic, or pentagonal prismatic, or hexagonal prismatic.

Compared with the prior art, the present invention has at least the following benefits:

1. The present invention can provide multiple pointing surfaces of different shapes and can thus integrate the functions of multiple prior art products of different specifications. Therefore, it is more economic and less costly.

2. The coupling of the gripping member and the working member according to the present invention enables more convenient adjustment of the working member, which can result in an increase in operating efficiency.

3. The present invention has superior sealing performance, which can protect the pointing tool against the influence of any filling material, thereby extending the service life and reducing the cost.

Below, the concept, structural details and resulting technical effects of the present invention will be further described with reference to the accompanying drawings to provide a full understanding of the objects, features and effects of the invention.

DETAILED DESCRIPTION OF THE PREFERRED EMBODIMENTS

Figure 1:
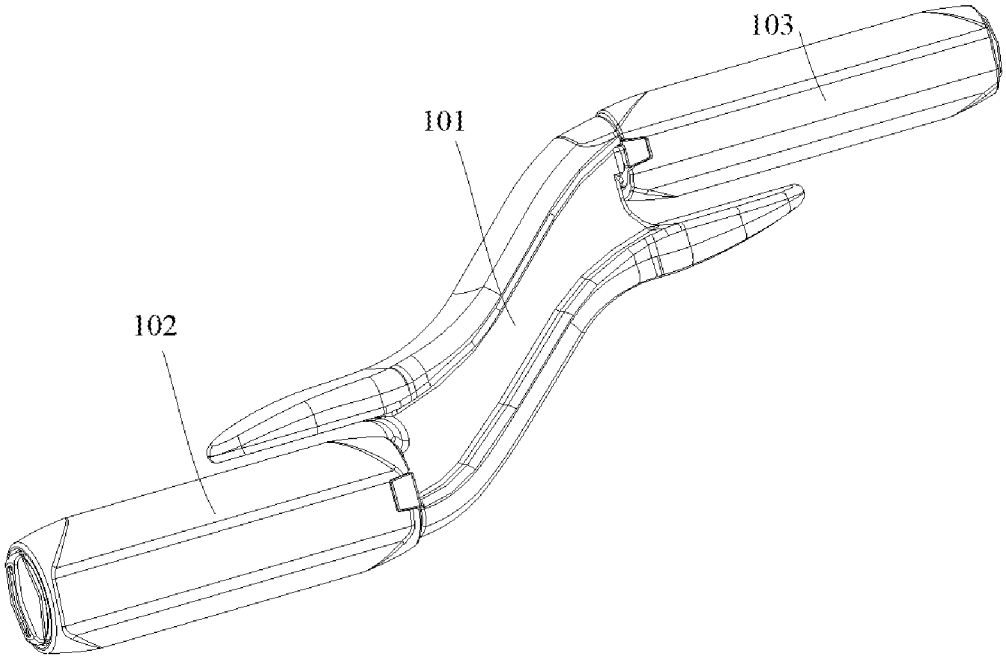
FIG. 1 is a schematic overview of one embodiment of the present invention.

Below, the drawings accompanying this specification are referenced to introduce many preferred embodiments of the present invention so that the techniques disclosed herein become more apparent and better understood. The present invention may be embodied in many different forms of embodiment, and its protection scope is not limited only to the embodiments mentioned herein.

Throughout the accompanying drawings, structurally identical parts are indicated with identical reference numerals, and structurally or functionally similar components are indicated with similar reference numerals. The size and thickness of each element in the drawings are arbitrarily depicted, and the present invention is not limited to any size or thickness of each element. For greater clarity of illustration, the thicknesses of some parts are exaggerated as appropriate somewhere in the drawings. According to the present application, all connecting members and working members are elongate, and the working members are disposed over the respective connecting members so as to be rotatable thereabout. In some embodiments, the connecting members are each an elongate connecting rod. A portion at an end proximal to a gripping member is referred to as a "base portion", as in the terms "base portion of the connecting member", "base portion of the working member", "base portion of the connecting rod" and the like that may be used herein. Moreover, a portion at an end distal from a gripping member is referred to as a "terminal portion", as in the terms "terminal portion of the connecting member", "terminal portion of the working member", "terminal portion of the connecting rod" and the like that may be used herein. For an elongate component, a direction along a length of this component is referred to as a "lateral direction", as in the terms "lateral position", "lateral movement" and the like that may be used herein.

Embodiment 1

Figure 2:
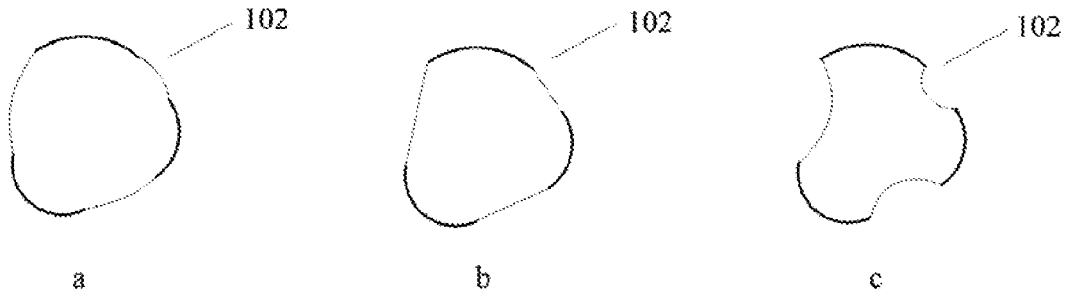
FIG. 2 schematically illustrates working surfaces in one embodiment of the present invention.
Figure 3:
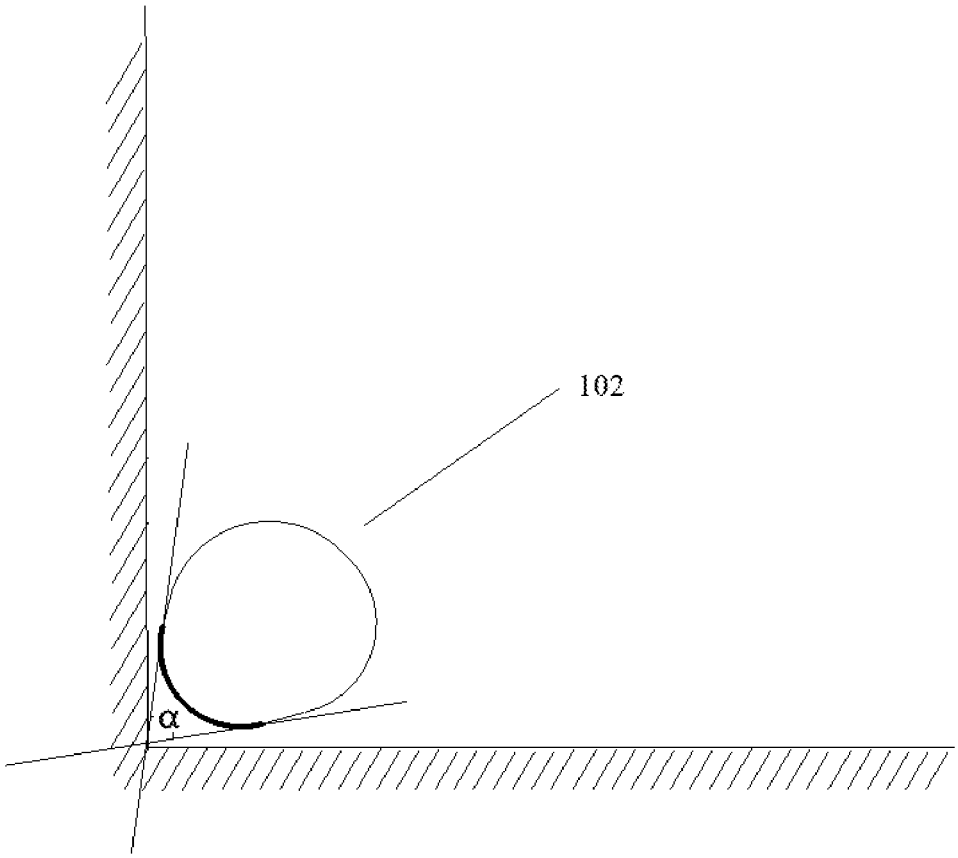
FIG. 3 schematically illustrates a working surface in one embodiment of the present invention.
Figure 4:
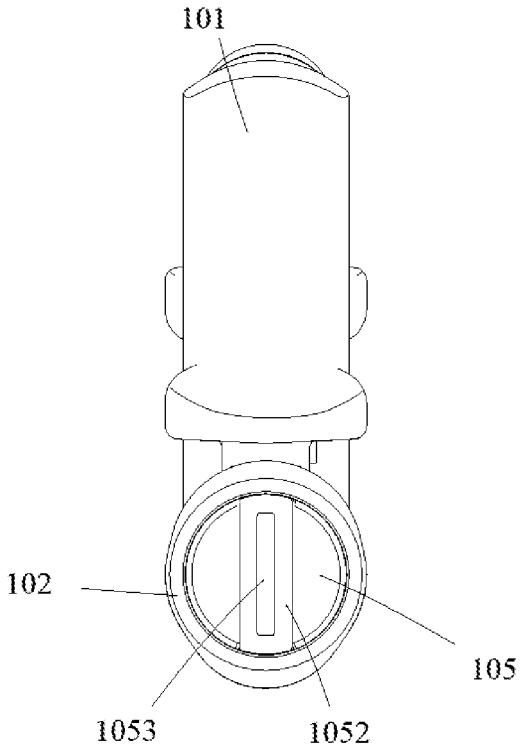
FIG. 4 is a side view of one embodiment of the present invention.
Figure 5:
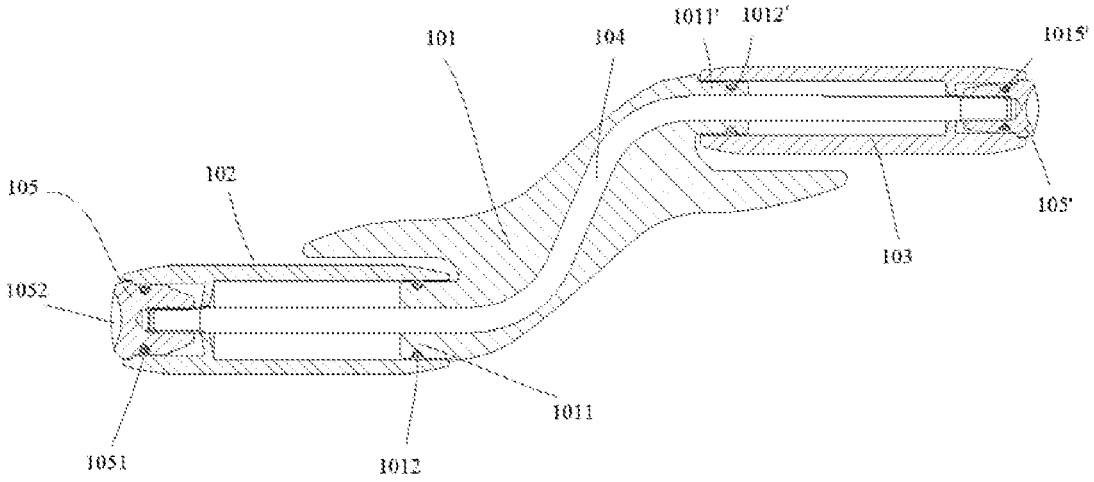
FIG. 5 is a cross-sectional view of one embodiment of the present invention.

As shown in FIGS. 1 to 6, this embodiment includes a gripping member 101. A first connecting part 1011 extends from one end of the gripping member 101, and a first sealing ring 1012 is disposed over the first connecting part 1011. A second connecting part 1011' extends from the other end of the gripping member 101, and a second sealing ring 1012' is disposed over the second connecting part 1011'. A first working member 102 and a second working member 103 are disposed over the first connecting part 1011 and the second connecting part 1011', respectively. The first working member 102 and the second working member 103 have different sizes and outer surface shapes, but both the first working member 102 and the second working member 103 are generally cylindrical. As part of a connecting member, the connecting rod 104 extends through the first connecting part 1011, the gripping member 101 and the second connecting part 1011', and both the first working member 102 and the second working member 103 are disposed over the connecting rod 104 so as to be rotatable about the connecting rod 104. Each of the first working member 102 and the second working member 103 has two cylindrical curved surfaces of different radii of curvature, which serve as working surfaces of the present invention. As used herein, the "radii of curvature" refer to those of curved lines of cross-sections of the working members in planes perpendicular to an axis of the connecting rod 104, which correspond to the working surfaces. As shown in FIG. 2, in other similar embodiments, each working member may have three working surfaces connected by transition surface portions. The transition surface portions may be circular cylindrical surfaces with greater radii of curvature than those of the working surfaces (i.e., convex surfaces, as shown in FIG. 2*a*), planes (as shown in FIG. 2*b*), or circular cylindrical surfaces with negative radii of curvature (i.e., concave surfaces, as shown in FIG. 2*c*). Regardless of how the transition surface portions are configured, in order to ensure satisfactory use of the working surfaces at wall corners, in the cross section of the working member, an angle formed between tangents at endpoints of the corresponding curved line of each working surface is desired to be an acute angle less than 90 degrees, such as the angle $\alpha$ shown in FIG. 3.

Figure 6:
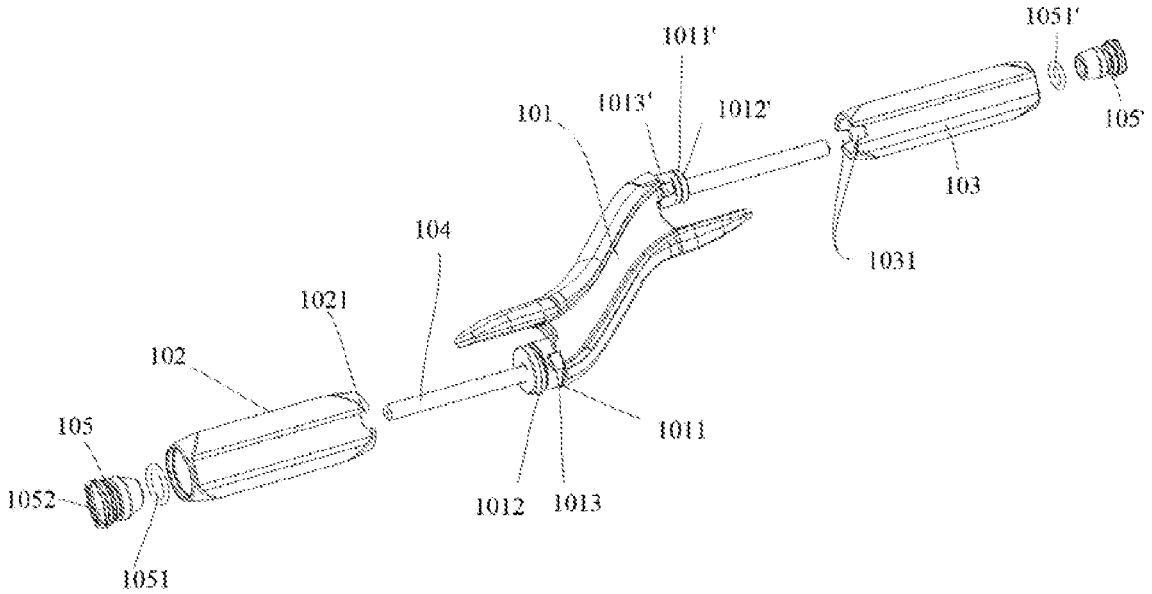
FIG. 6 is an exploded schematic view of one embodiment of the present invention.

As a stop mechanism in this embodiment, the connecting members are provided thereon with elongate stop bodies, and the working members are provided with elongate stop recesses complementary in shape thereto. Specifically, as shown in FIG. 6, a first stop block 1013 may be provided on the first connecting part 1011, and a second stop block 1013' may be provided on the second connecting part 1011'. Correspondingly, two first stop notches 1021 may be provided in the two different circular cylindrical surfaces of the first working member 102, and two second stop notches 1031 may be provided in the two different circular cylindrical surfaces of the second working member 103. When the first stop block 1013 moves into engagement with any of the two first stop notches 1021 as a result of lateral displacement of the first working member 102 over the connecting rod 104, the first working member 102 is stopped in position. If the first stop block 1013 fails to engage with any of the first stop notches 1021, i.e., the first stop block 1013 remains separate from the first stop notches 1021, the first working member 102 is not stopped and angular adjustment thereof is allowed. Correspondingly, when the second stop block 1013' moves into engagement with any of the two second stop notches 1031 as a result of lateral displacement of the second working member 103 over the connecting rod 104, the second working member 103 is stopped in position. If the second stop block 1013' fails to engage with any of the second stop notches 1031, i.e., the second stop block 1013' remains separate from the second stop notches 1031, the second working member 103 is not stopped and angular adjustment thereof is allowed. A first trailing plug 105 and a second trailing plug 105' are threadedly coupled to opposing ends of the connecting rod 104. The first trailing plug 105 is disposed at a terminal end of the first working member 102, and the second trailing plug 105' is disposed at a terminal end of the second working member 103. The first trailing plug 105 and the second trailing plug 105' are used to limit lateral displacement of the first working member 102 and the second working member 103 on the connecting rod 104. The first trailing plug 105 and the second trailing plug 105' are provided thereon with a third sealing ring 1051 and a fourth sealing ring 1051', respectively. The first trailing plug 105 is provided thereon with a first elongate rotary handle 1052, which can facilitate rotation of the first trailing plug 105 by an operator's hand. The first elongate rotary handle 1052 is raised over a terminal end face of the first working member 102. The first elongate rotary handle 1052 is provided in a surface thereof a first elongate groove 1053, in which the insertion of a simple tool (e.g., a screwdriver) for rotating the first trailing plug 105 can be accommodated. Correspondingly, the second trailing plug 105' is provided thereon with a second elongate rotary handle and a second elongate groove (not shown) for a similar purpose.

In order to make an adjustment to the first working member 102, the first trailing plug 105 is screwed via the first elongate rotary handle 1052 a predetermined distance out of the first working member 102 to allow the first working member 102 to displace laterally to separate the first stop block 1013 from the first stop notch 1021. As a result, the first working member 102 is in an adjustable configuration. After the first working member 102 is rotated to a deployment position of a desired circular cylindrical surface, the first stop block 1013 is aligned with one of the first stop notches 1021, and the first trailing plug 105 is tightened to cause the first working member 102 to laterally move to again engage the first stop block 1013 with the first stop notch 1021, thereby locking the first working member 102. The second working member 103 can be adjusted by manipulating the second trailing plug 105' in a similar manner involving disengagement of the second stop block 1013' from the second stop notch 1031 and reengagement of the second stop block 1013' with one of the second stop notches 1031, and similar results can be obtained.

It is to be noted that, although the first working member 102 and the second working member 103 have been described in this embodiment as being sized distinctly and having outer surfaces with different radii of curvature, in alternative embodiments, the first working member 102 and the second working member 103 may be identically sized or have components with identical outer surfaces. In this embodiment, one first stop block 1013 and one second stop block 1013' are provided, but in alternative embodiments, the same number of first stop blocks 1013 and first stop notches 1021 and the same number of second stop block 1013' and second stop notches 1031 may be provided. In further embodiments, the stop notch(es) may be provided in the connecting members and the stop block(s) on the working members. That is, they are swapped in position, as compared to this embodiment. Similar effects can be obtained.

Embodiment 2

Figure 7:
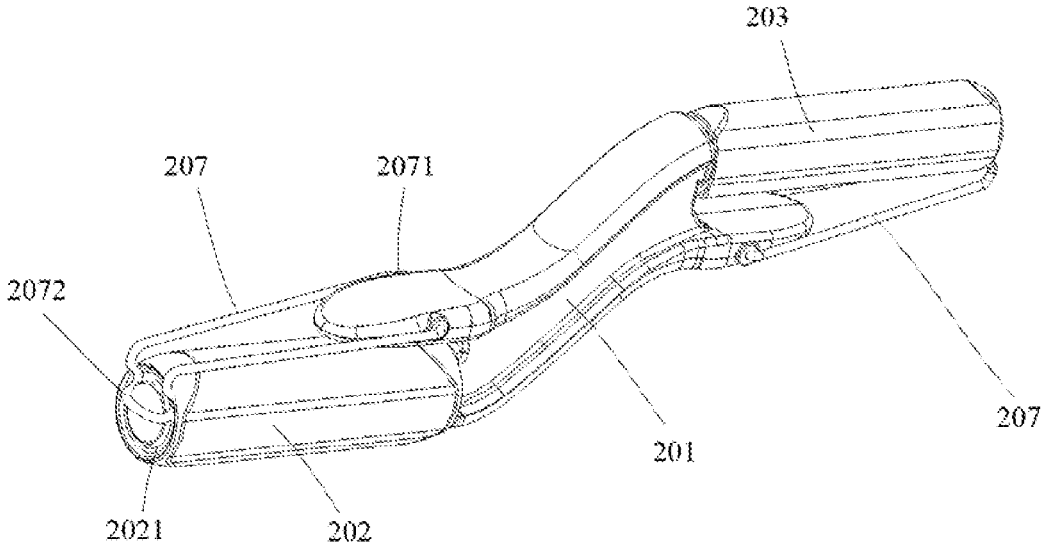
FIG. 7 is a schematic overview of another embodiment of the present invention.
Figure 8:
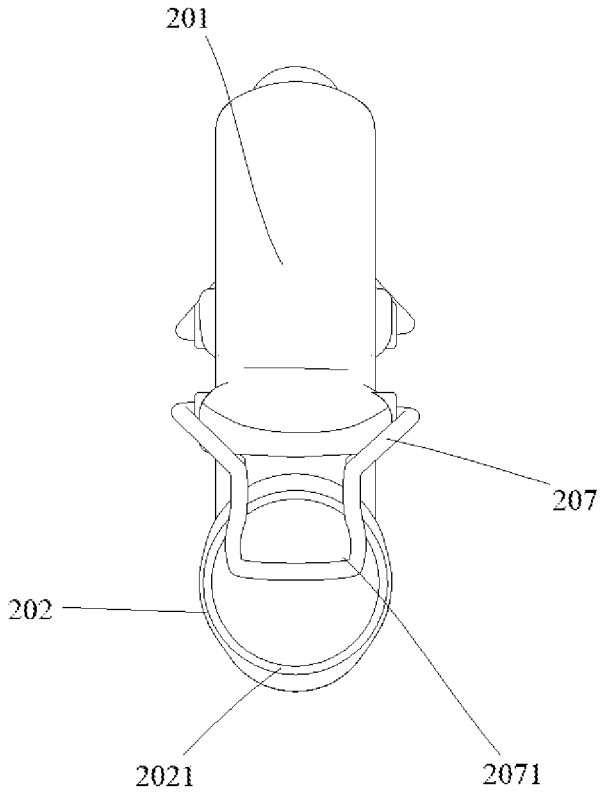
FIG. 8 is a side view of another embodiment of the present invention.
Figure 9:
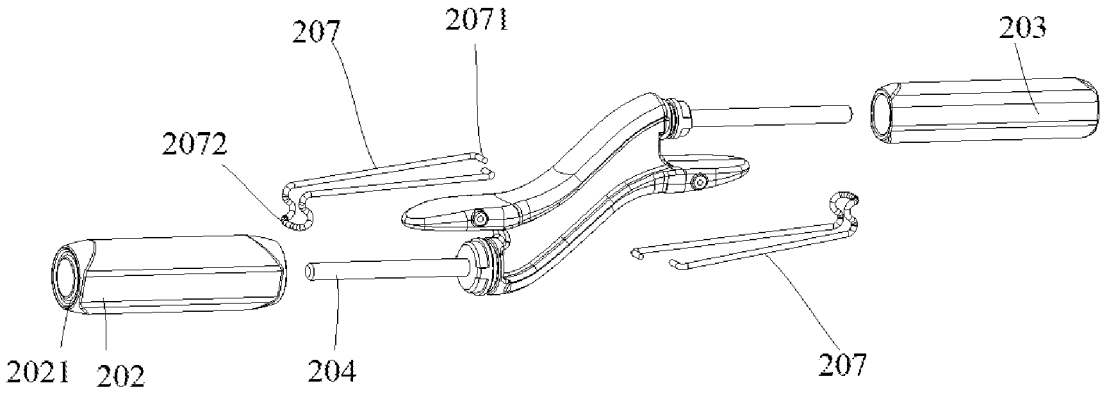
FIG. 9 is an exploded schematic view of another embodiment of the present invention.
Figure 10:
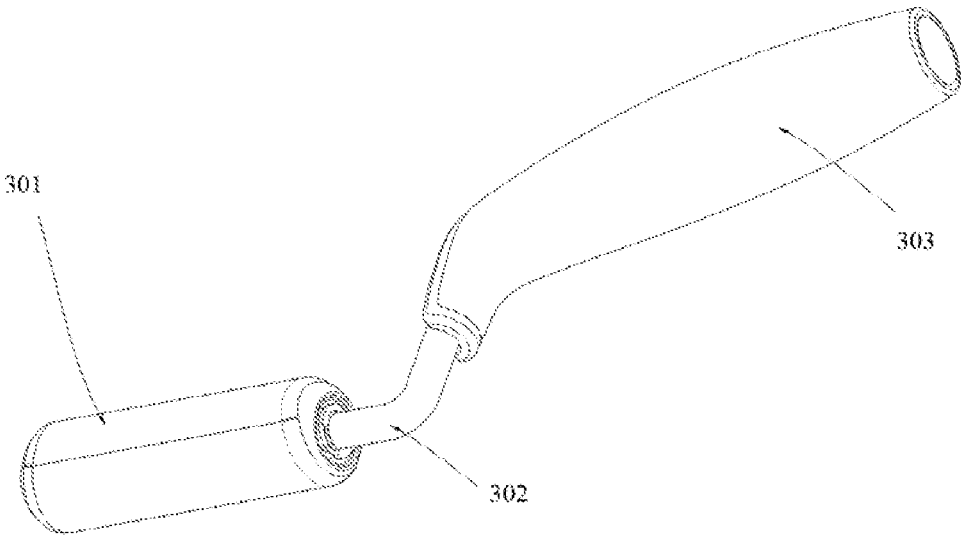
FIG. 10 is a schematic overview of a further embodiment of the present invention.
Figure 11:
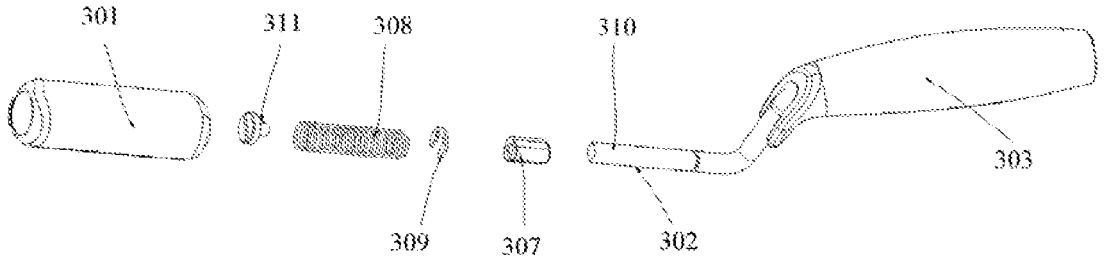
FIG. 11 is an exploded schematic view of a further embodiment of the present invention.
Figure 12:
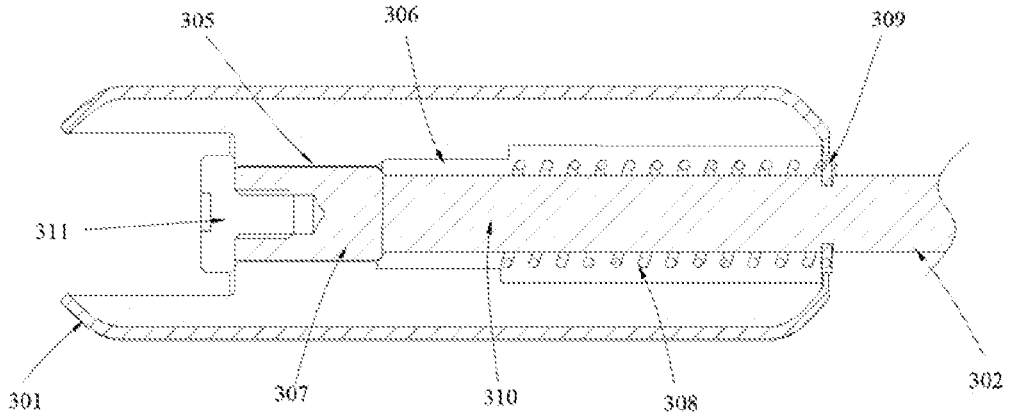
FIG. 12 is a cross-sectional view of another embodiment of the present invention.

As shown in FIGS. 7 to 9, this embodiment includes a gripping member 201, a first working member 202, a second working member 203 and a connecting rod 204, which are the same as the gripping member 101, the first working member 102, the second working member 103 and the connecting rod 104 in Embodiment 1. This embodiment differs from embodiment 1 in having a different stop mechanism. In this embodiment, the first working member 202 and the second working member 203 are stoppable by two metal wires 207. Each metal wire 207 includes fixed metal wire sections 2071 and a movable metal wire section 2072. The fixed metal wire sections 2071 are rotatably coupled to the first connecting part. In this embodiment, specifically, metal wire securing holes are provided on opposing side faces of the first connecting part, and the fixed metal wire sections 2017 are inserted into the metal wire securing holes to pivotably couple the metal wire 207 to the first connecting part. The movable metal wire section 2072 is annular and defines an opening. The first working member 202 and the second working member 203 are provided at their terminal ends with a first stop groove 2021 and a second stop groove (not shown), with which the movable metal wire sections 2072 can engage in a self-locating manner. Upon the movable metal wire section 2072 coming into engagement with the first stop groove 2021, the first working member 202 will be stopped in position. When the movable metal wire section 2072 is separated from the first stop groove 2021, adjustment of the first working member 202 is possible. The second working member 203 can be stopped and enabled to allow adjustment by manipulation the metal wire 2072 with respect to the second stop groove in a similar manner.

Embodiment 3

As shown in FIGS. 10 to 13, this embodiment includes a first working member 301, a first connecting part 302 and a gripping member 303 fixedly attached to the first connecting part 302. The first working member 301 is a hollow triangular prism having an outer surface including three cylindrical curved surfaces with different radii of curvature and an inner surface defining a hollow circular cylindrical cavity. The first working member 301 is disposed over the first connecting part 302 so that the first connecting part 302 is received within its hollow cavity and that it can rotate about the first connecting part 302. The hollow cavity is provided at a terminal end thereof with a triangular prismatic stop recess 305, and an inward circular collar 306 is provided at the junction of the hollow cavity and the triangular prismatic stop recess 305. The first connecting part 302 includes a substantially circular cylindrical connecting rod 310, and the connecting rod 310 is detachably provided at a terminal end thereof corresponding to the stop recess 305 with a triangular prismatic stop body 307 matching the stop recess 305 in terms of both shape and dimensions. The connecting rod 310 is also disposed thereover with a spring 308, one end of which is stopped at the circular collar 306 in the hollow cavity. A trailing plug 309 is detachably provided at a trailing end of the hollow cavity, and the other end of the spring 308 is stopped at the trailing plug 309 so that the spring 308 is confined within the hollow cavity of the first working member 301. The first working member 301 is detachably coupled to the connecting rod 310 by a screw 311.

Figure 13:
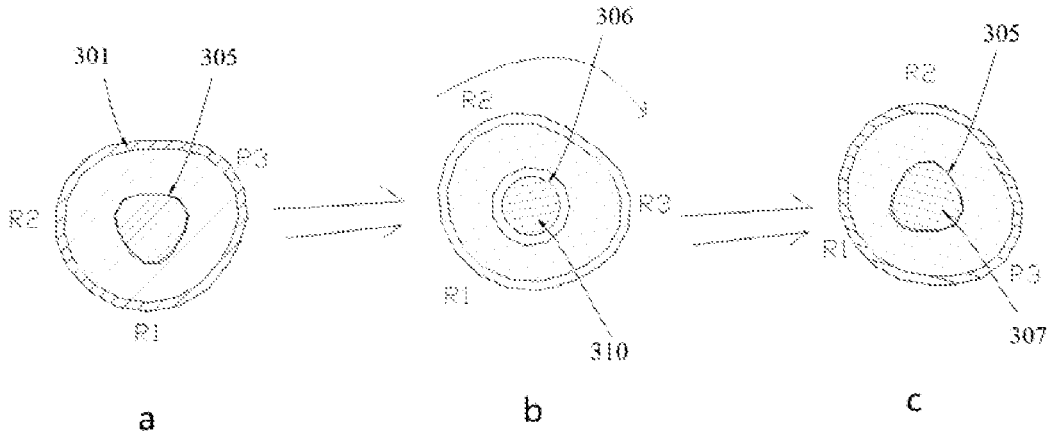
FIG. 13 shows a switch between different configurations as a result of an adjustment action in another embodiment of the present invention.

In order to make an adjustment to the first working member 301, as shown in FIG. 13, a lateral external force is applied to the first working member 301 to cause it to move toward a trailing end of the connecting rod 310. As a result, the end of the spring 308 stopped by the trailing cover 309 does not displace, while the other end of the spring 308 is driven by the circular collar 306 to move toward the trailing end of the connecting rod 310, resulting in compression of the spring 308. As another result of the lateral displacement of the first working member 301, the triangular prismatic stop recess 305 is separated from the triangular prismatic stop body 307, allowing the first working member 301 to be rotated and adjusted, i.e., switched from configuration a to b as shown in FIG. 13. When a desired circular cylindrical surface is adjusted to the deployment position, the lateral external force applied to the first working member 301 is withdrawn to release the first working member 301. Under the action of the spring 308, the triangular prismatic stop body 307 is pulled back into the triangular prismatic stop recess 305 of the first working member 301, again stopping the first working member 301. As a result of this process, a switch from configuration b to c as shown in FIG. 13 is accomplished.

Embodiment 4

Figure 14:
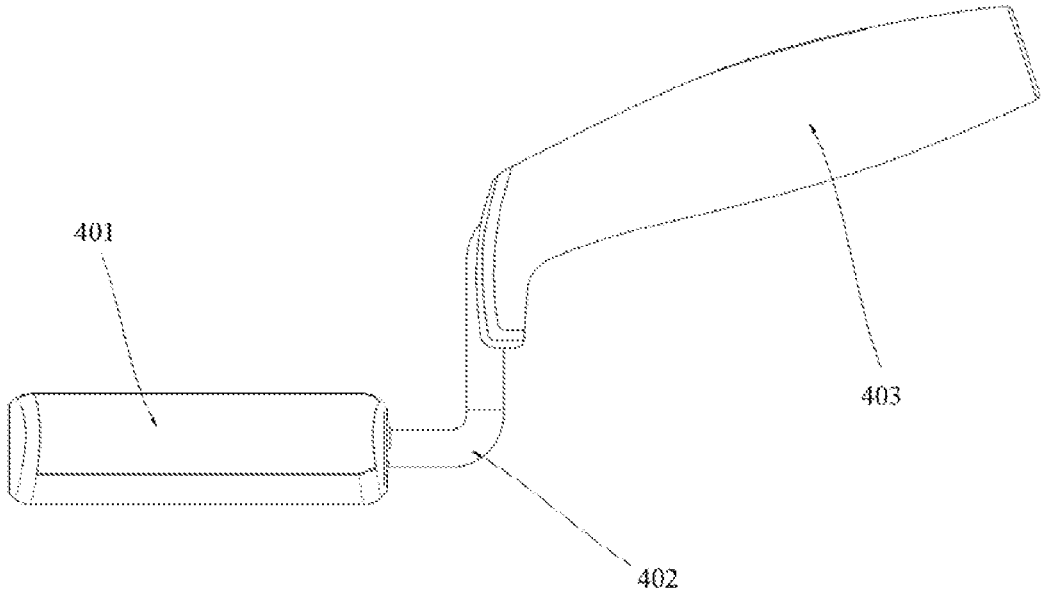
FIG. 14 is a schematic overview of a further embodiment of the present invention.
Figure 15:
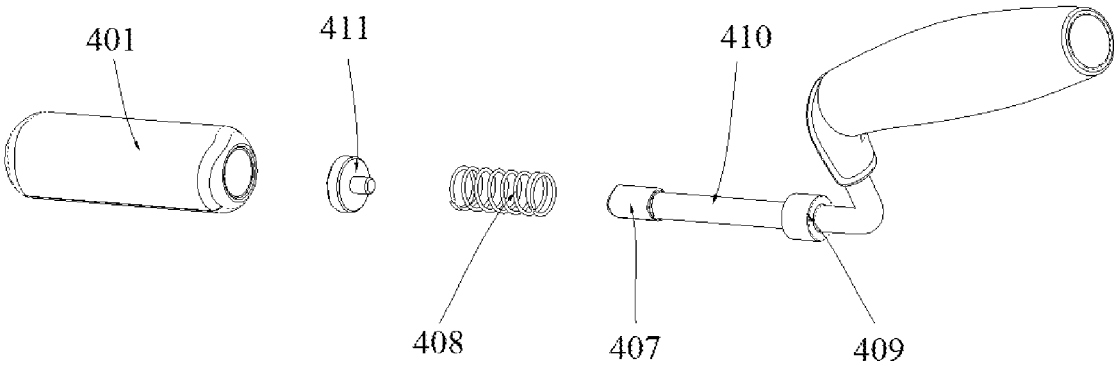
FIG. 15 is an exploded schematic view of a further embodiment of the present invention.
Figure 16:
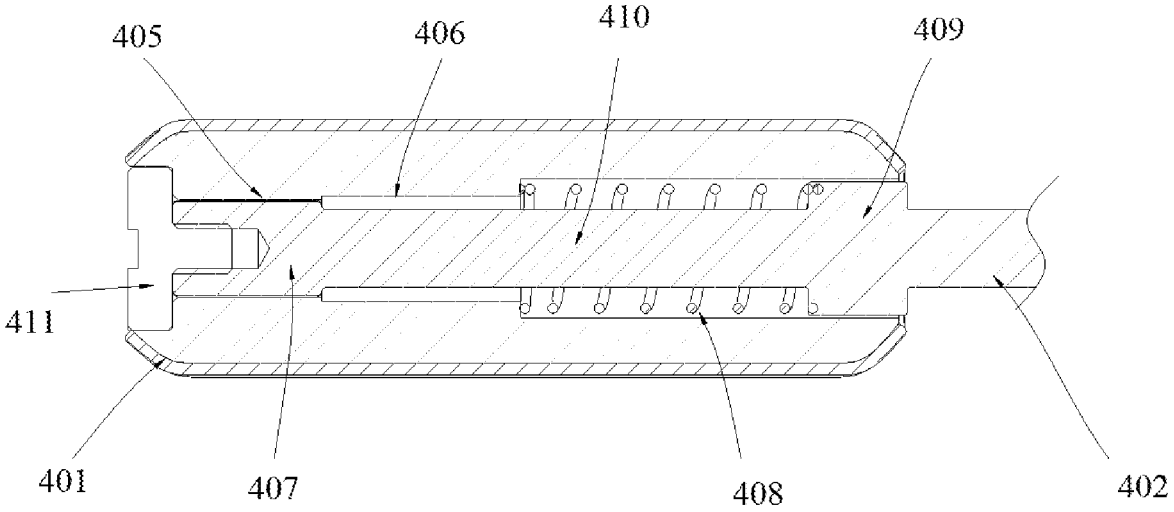
FIG. 16 is a cross-sectional view of a variant of one embodiment of the present invention.

As shown in FIGS. 14 to 16, this embodiment includes a first working member 401, a first connecting part 402, a gripping member 403, a triangular prismatic stop recess 405, a circular collar 406, a triangular prismatic stop body 407, a spring 408, a trailing cover 409, a connecting rod 410 and a screw 411, which are the same as those of Embodiment 3.

This embodiment differs from Embodiment 3 in that the triangular prismatic stop body 407 is fixed to the connecting rod 410, preferably integrally formed therewith. Moreover, the trailing cover 409 is fixed to the connecting rod 410, preferably integrally formed therewith. This can simplify the structure of the components and avoid separate fabrication of the three different components followed by assembly of them together, thereby reducing the cost and improving the device's stability.

Embodiment 5

Figure 17:
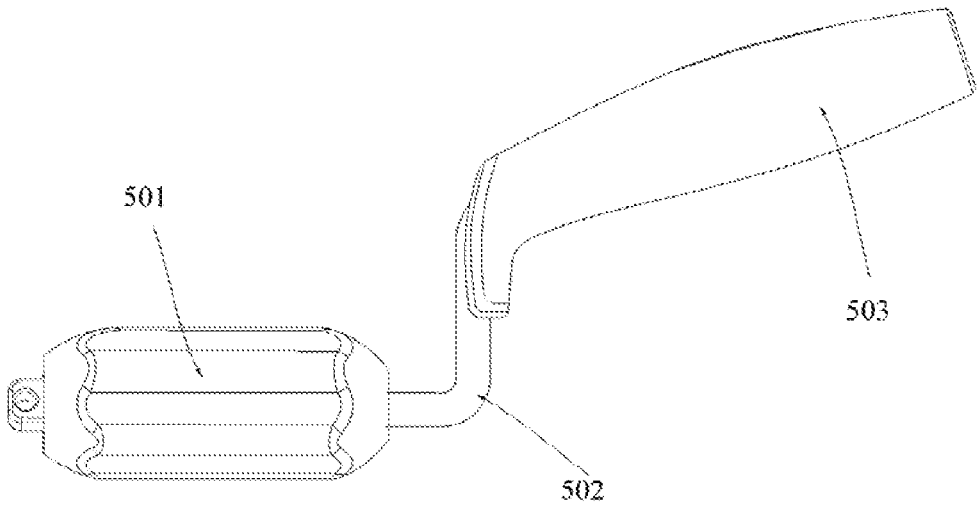
FIG. 17 is a schematic overview of a further embodiment of the present invention.
Figure 18:
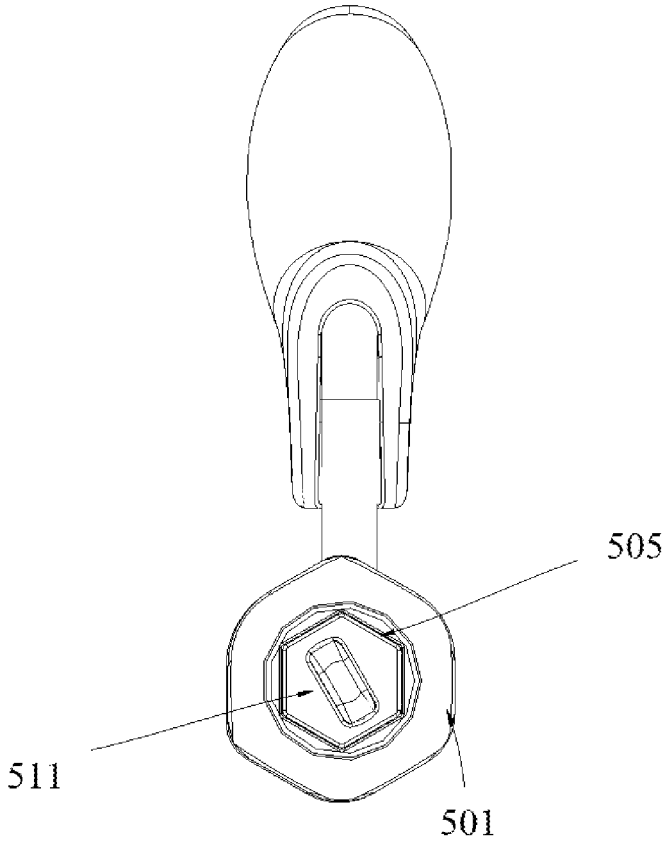
FIG. 18 is a side view of a further embodiment of the present invention.

As shown in FIGS. 17 to 18, this embodiment comprises a first working member 501 having a hexagonal prismatic outer surface including six circular cylindrical surfaces with different radii of curvature. The first working member 501 is disposed over a first connecting part 502. The first connecting part 502, as well as a gripping member 503, is the same as that of Embodiment 3.

In a stop mechanism of this embodiment, an inner surface of the first working member 501 defines a hexagonal prismatic stop recess 505 in shape correspondence with the hexagonal prismatic outer surface, and a hexagonal prismatic stop body complementary in shape thereto is provided. Different from the previous embodiment, the hexagonal prismatic stop body in this embodiment further includes a locking pin 511. In order to make an adjustment to the first working member 501, the locking pin 511 is pulled toward a terminal end of the first connecting part 502 to cause the hexagonal prismatic stop body to separate from the hexagonal prismatic stop recess 505 to allow the first working member 501 to be rotated and adjusted. When a suitable circular cylindrical surface is adjusted to the deployed position, the locking pin 511 is inserted in a direction toward a trailing end of the first connecting part 502 to engage the hexagonal prismatic stop body with the hexagonal prismatic stop recess 505, thereby locking the first working member 501.

Embodiment 6

Figure 19:
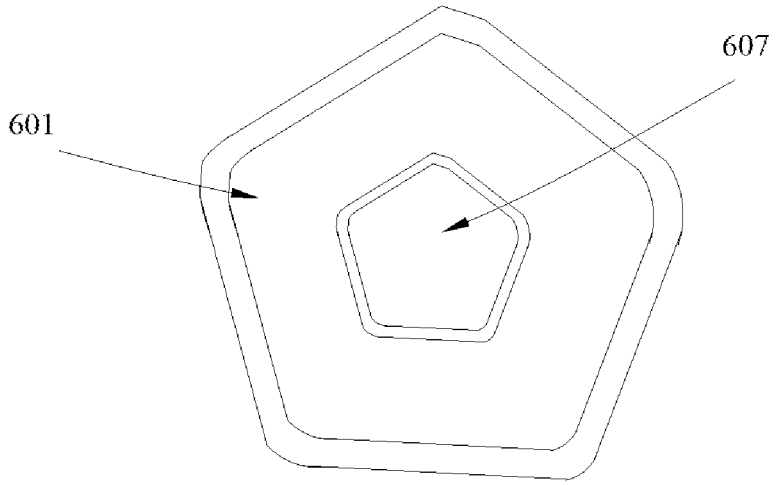
FIG. 19 is a cross-sectional view of a working member in a further embodiment of the present invention.

As shown in FIG. 19, a working member in this embodiment is a first working member 601 defining a pentagonal prismatic stop recess, and a corresponding pentagonal prismatic stop body 607 is provided correspondingly. It is to be noted that the shapes of the working member, the stop recess and the stop body of this embodiment are applicable to other embodiments of the present application. Alternatively, the shape of the working member, the stop recess and the stop body in other embodiments may be configured as a triangular, quadrangular, pentagonal, hexagonal and higher-order polygonal shape.

Embodiment 7

Figure 20:
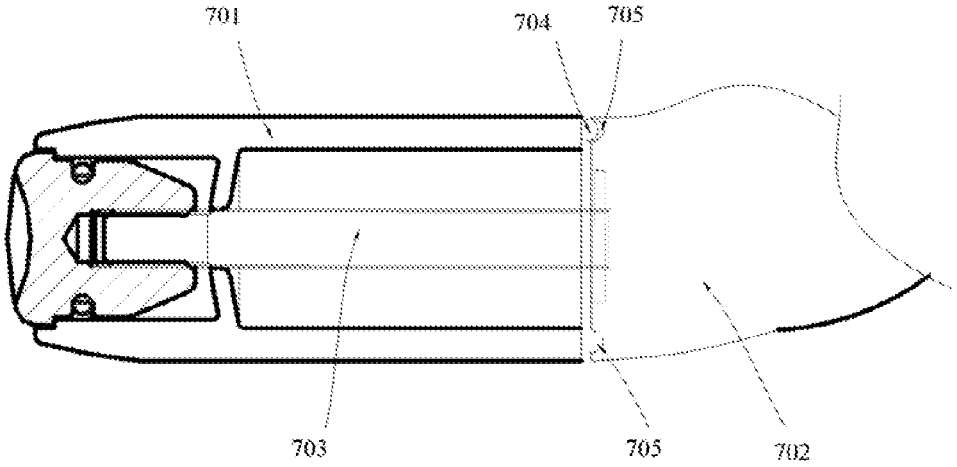
FIG. 20 is a cross-sectional view of a working member in a further embodiment of the present invention, wherein 101 denotes a gripping member; 1011, a first connecting part; 1011', a second connecting part; 1012, a first sealing ring; 1012', a second sealing ring; 1013, a first stop block; 1013', a second stop block; 102, a first working member; 1021, a first stop notch; 103, a second working member; 1031, a second stop notch; 104, a connecting rod; 105, a first trailing plug; 105', a second trailing plug; 1051, a third sealing ring; 1051', a fourth sealing ring; 1052, a first elongate rotary handle; 1053, a first elongate groove; 201, a gripping member; 202, a first working member; 2021, a first stop groove; 203, a second stop groove; 204, a connecting rod; 207, a metal wire; 2071, fixed metal wire sections; 2072, a movable metal wire section; 301, a first working member; 302, a first connecting part; 303, a gripping member; 305, a triangular prismatic stop recess; 306, a circular collar; 307, a triangular prismatic stop body; 308, a spring; 309, a trailing cover; 310, a connecting rod; 311, a screw; 401, a first working member; 402, a first connecting part; 403, a gripping member; 405, a triangular prismatic stop recess; 406, a circular collar; 407, a triangular prismatic stop body; 408, a spring; 409, a trailing cover; 410, a connecting rod; 411, a screw; 501, a first working member; 502, a first connecting part; 503, a gripping member; 505, a hexagonal prismatic stop recess; 511, a locking pin; 601, a first working member; 607, a pentagonal prismatic stop body; 701, a first working member; 702, a gripping member; 703, a threaded rod; 704, raised beads; and 705, bead receiving pockets.

As shown in FIG. 20, a first working member 701 and a gripping member 702 are coupled by a threaded rod 703 in this embodiment. The first working member 701 can rotate about the threaded rod 703, and a side face of a base portion of the first working member 701 is engaged with a gripping member 702. The first working member 701 is provided on the side face of the base portion with a plurality of raised beads 704, and bead receiving pockets 705 is provided in a side face of the gripping member 702 with which the side face of the base portion of the first working member 701 is engaged. The raised beads 704 and bead receiving pockets 705 are in positional correspondence. In order to make an adjustment to the first working member 701, the threaded rod 703 is rotated to drive the first working member to rotate about the threaded rod 703 to cause the raised beads 704 to leave the bead receiving pockets 705. Upon the raised beads 704 being again received in the bead receiving pockets 705 at another position, the first working member 701 is stopped.

Preferred specific embodiments have been described in detail above. It is to be understood that, those of ordinary skill in the art can make various modifications and changes based on the concept of the present invention without exerting any creative effort. Accordingly, all the technical solutions that can be obtained by those skilled in the art by logical analysis, inference or limited experimentation in accordance with the concept of the present invention on the basis of the prior art are intended to fall within the protection scope as defined by the claims.

I claim:

1. A pointing tool, comprising:

a connecting part;

a working member; and a gripping member, wherein the connecting part comprises a first connecting part, and the working member comprises a first working member including a plurality of first working surfaces; the first connecting part extends from one end of the gripping member, and the first working member is rotatably disposed over the first connecting part, such that it is able to rotate to adjust the position of the first working surfaces;

wherein the first working surfaces are cylindrical curved surfaces with different radii of curvature, and an angle formed between tangents at endpoints of a corresponding curved line of each first working surface is an acute angle of less than 90 degrees, wherein the first working surfaces are connected by first transition surfaces, which are planes, circular cylindrical surfaces having radii of curvature greater than those of the first working surfaces, or circular cylindrical surfaces having negative radii of curvature;

wherein the connection part further comprises a second connecting part extending from an end of the gripping member opposite to the first connecting part, the working member further comprises a second working member including a plurality of second working surfaces, the second working member is rotatably disposed over the second connecting part, such that is able to rotate to adjust the second working surfaces;

wherein the second working surfaces are cylindrical curved surfaces with different radii of curvature, and an angle formed between tangents at endpoints of a corresponding curved line of each second working surface is an acute angle of less than 90 degrees, wherein the second working surfaces are connected by second transition surfaces, which are planes, circular cylindrical surfaces having radii of curvature greater than those of the second working surfaces, or circular cylindrical surfaces having negative radii of curvature; and wherein the first working member differs from the second working member in outer surface shape and size, the first connecting part having the same structure as that of the second connecting part.

2. The pointing tool of claim 1, wherein the pointing tool further comprises a stop mechanism configured to maintain the first working member at a constant position with respect to the first connecting part.

3. The pointing tool of claim 2, wherein the stop mechanism comprises a polygonal prismatic stop recess provided at an inner surface of the first working member and a polygonal prismatic stop body provided in a terminal portion of the first connecting part, the polygonal prismatic stop body matching the polygonal prismatic stop recess in size and shape, the polygonal prismatic stop recess having degrees of surface curvature matching degrees of curvature of an outer surface of the first working member at corresponding positions, when the first working member is laterally moving over the first connecting part, the polygonal prismatic stop body is able to engage with or disengage from the polygonal prismatic stop recess, the polygonal prismatic stop body engaging with the polygonal prismatic stop recess to maintain the first working member at a constant position with respect to the first connecting part, the polygonal prismatic stop body disengaging from the polygonal prismatic stop recess to enable the first working member to be rotatable about the first connecting part.

4. The pointing tool of claim 3, wherein the stop mechanism further comprises a locking pin fixedly coupled to the polygonal prismatic stop body, the locking pin inserted and pulled out to enable the polygonal prismatic stop body to engage with and disengage from the polygonal prismatic stop recess.

5. The pointing tool of claim 3, wherein the stop mechanism further comprises a spring disposed within the first working member, the spring disposed over the first connecting part together with the polygonal prismatic stop body, one end of the spring coupled to the terminal portion of the first working member and another end coupled to a base portion of the first connecting part, the spring compressed when the polygonal prismatic stop body disengages from the polygonal prismatic stop recess, the spring returning to a rest state in absence of an external force to enable the polygonal prismatic stop body to engage with the polygonal prismatic stop recess.

6. The pointing tool of claim 5, wherein an inner surface of the terminal portion of the first working member is provided with a collar, the one end of the spring being coupled to the collar, the base portion of the first connecting part being provided with a trailing cover receptacle, a trailing cover being snapped into the trailing cover receptacle and thereby fixedly coupled to the first connecting part, the another end of the spring being fixedly coupled to the trailing cover.

7. The pointing tool of claim 6, wherein the polygonal prismatic stop body and the trailing cover are integrally formed over the first connecting part.

8. The pointing tool of claim 7, wherein the outer surface of the first working member is triangular prismatic, or quadrangular prismatic, or pentagonal prismatic, or hexagonal prismatic.

9. The pointing tool of claim 8, wherein the pointing tool further comprises a sealing member, the sealing member disposed in the terminal portion of the first working member.

10. The pointing tool of claim 2, wherein the first working member is coupled to the gripping member at a base portion of the first connecting part, either of the first working member or the gripping member being provided therein with a plurality of elongate stop recesses, the other of them being provided thereon with elongate stop body, the elongate stop body matching the elongate stop recesses in size, when the first working member is laterally moving over the first connecting part, the elongate stop body is able to snap into or leave from the elongate stop recesses, the elongate stop body snapping into the elongate stop recesses to maintain the first working member at a constant position with respect to the first connecting part, the elongate stop body leaving from the elongate stop recesses to enable the first working member being rotatable about the first connecting part.

11. The pointing tool of claim 10, wherein the number of the elongate stop recesses is the same as the number of the elongate stop body.

12. The pointing tool of claim 11, wherein the stop mechanism further comprises a trailing plug provided in a terminal portion of the first connecting part, the trailing plug configured to limit a lateral position of the first working member and, through altering a lateral position of the trailing plug, control the elongate stop body to snap into and leave from the elongate stop recesses.

13. The pointing tool of claim 12, wherein the trailing plug comprises an elongate rotary handle, the elongate rotary handle configured to be raised over an end face of the first working member, the elongate rotary handle used to change the lateral position of the trailing plug.

14. The pointing tool of claim 13, wherein the trailing plug comprises an elongate groove, the elongate groove used to change the lateral position of the trailing plug.

15. The pointing tool of claim 2, wherein the stop mechanism comprises a metal wire, one end of the metal wire coupled to the first connecting part, the first working member provided in a terminal portion thereof with a stop groove, the stop groove matching the metal wire in size, another end of the metal wire snapping into the stop groove resulting in the first working member being stopped, the another end of the metal wire leaving from the stop groove resulting in adjustability of the first working member.

16. The pointing tool of claim 15, wherein the first connecting part is provided in a surface thereof with metal wire securing holes, the metal wire being inserted into the metal wire securing holes to be pivotably coupled to the first connecting part.

17. The pointing tool of claim 2, wherein the first connecting part comprises a threaded rod, the first working member being fixedly coupled to the threaded rod, the threaded rod being rotatably coupled to the gripping member, a side face of a base portion of the first working member being engaged with a side face of the gripping member, one of the side face of the base portion of the first working member and the side face of the gripping member being provided thereon with raised beads, the other of them being provided therein with bead receiving pockets, the raised beads and the bead receiving pockets being arranged around the threaded rod, the raised beads being in positional correspondence with the bead receiving pockets, when the first connecting part is being rotated with the threaded rod relative to the gripping member, the raised beads being able to snap into or leave from the bead receiving pockets, the raised beads snapping into the bead receiving pockets to maintain the first working member at a constant position with respect to the first connecting part, the raised beads leaving from the bead receiving pockets to enable the first working member being rotatable about the first connecting part.

18. The pointing tool of claim 1, wherein the outer surface of the first working member or the second working member is triangular prismatic, or quadrangular prismatic, or pentagonal prismatic, or hexagonal prismatic.

* * * * *